US011044986B2

(12) United States Patent
Thomas

(10) Patent No.: US 11,044,986 B2
(45) Date of Patent: Jun. 29, 2021

(54) TETHERED CHEST POUCH ASSEMBLY

(71) Applicant: VRYPAC, LLC, Washington, DC (US)

(72) Inventor: Teka Ewart Thomas, Washington, DC (US)

(73) Assignee: Vrypac, LLC, Washington, DC (US)

( * ) Notice: Subject to any disclaimer, the term of this patent is extended or adjusted under 35 U.S.C. 154(b) by 0 days.

(21) Appl. No.: 16/906,344

(22) Filed: Jun. 19, 2020

(65) Prior Publication Data

US 2021/0106125 A1 Apr. 15, 2021

Related U.S. Application Data

(60) Provisional application No. 62/915,119, filed on Oct. 15, 2019, provisional application No. 63/011,626, filed on Apr. 17, 2020.

(51) Int. Cl.

| | |
|---|---|
| ***A45F 3/14*** | (2006.01) |
| ***A45F 5/00*** | (2006.01) |
| ***F16M 13/04*** | (2006.01) |
| ***A45F 3/04*** | (2006.01) |
| ***A45F 5/02*** | (2006.01) |
| *A45F 3/00* | (2006.01) |
| *A45C 11/00* | (2006.01) |

(52) U.S. Cl.

CPC ..... *A45F 3/14* (2013.01); *A45F 3/04* (2013.01); *A45F 5/02* (2013.01); *A45C 2011/002* (2013.01); *A45F 2003/003* (2013.01); *A45F 2003/142* (2013.01); *A45F 2003/146* (2013.01); *A45F 2200/055* (2013.01); *A45F 2200/0516* (2013.01)

(58) Field of Classification Search

CPC ..... A45F 2200/0516; A45F 2200/0525; A45F 2003/146; A45F 2005/006; F16M 13/04; A45C 2011/002

USPC ..... 224/623

See application file for complete search history.

(56) References Cited

U.S. PATENT DOCUMENTS

| | | | | |
|---|---|---|---|---|
| 2,853,709 | A * | 9/1958 | Peterson | A41D 13/0012 2/51 |
| 3,541,976 | A * | 11/1970 | Rozas | A47B 23/002 108/43 |
| 3,884,403 | A | 5/1975 | Brewer | |
| 4,561,576 | A | 12/1985 | Lowe et al. | |
| 4,872,599 | A | 10/1989 | Hubbard et al. | |
| 5,333,768 | A * | 8/1994 | Krentz | A45F 3/14 224/623 |
| 5,526,535 | A * | 6/1996 | Dobrzenski | A41D 13/0012 2/102 |

(Continued)

*Primary Examiner* — Justin M Larson

(74) *Attorney, Agent, or Firm* — Westberg Law Offices

(57) ABSTRACT

A tethered chest pouch assembly for carrying a personal electronic device comprises a pouch having a closable opening configured to receive a personal electronic device. The assembly additionally comprises a base panel configured to be worn by a user in or around the user's chest area. The pouch is postionable with respect to the panel in at least: a closed position in which the pouch is releasably fastened substantially flat against the panel; an open position in which a top of the pouch is rotated outwardly from the panel while the pouch remains attached to the panel near a lower edge of the pouch; and a tethered position in which the pouch is tethered to the panel. The pouch may additionally be completely decoupled from the base panel.

17 Claims, 13 Drawing Sheets

(56) References Cited

U.S. PATENT DOCUMENTS 6,106,016 A 8/2000 Bette
6,359,609 B1 * 3/2002 Kuenster ..... G06F 1/163 224/270
6,729,520 B2 * 5/2004 Gilbert ..... A45F 3/14 224/219
6,962,277 B2 * 11/2005 Quintana ..... A45F 3/14 224/262
7,099,710 B1 * 8/2006 Faillance ..... A45F 5/00 455/575.1
7,665,641 B2 * 2/2010 Kaufman ..... G06F 1/163 224/261
7,683,969 B2 * 3/2010 Callahan ..... F16M 11/10 348/376
7,712,645 B2 * 5/2010 Calkin ..... A45F 3/06 224/649
7,818,034 B2 * 10/2010 Richards ..... H04B 1/3833 455/575.1
8,267,294 B2 * 9/2012 Yu ..... F16M 11/24 224/623
8,418,629 B2 * 4/2013 Yu ..... F16M 13/04 108/43
8,505,790 B2 * 8/2013 Yu ..... F16M 11/2014 224/185
D697,708 S * 1/2014 Denzer ..... D3/215
8,863,314 B2 * 10/2014 Raviv ..... A41D 27/205 2/115
9,504,300 B1 * 11/2016 Donahue ..... F16M 11/38
9,510,662 B1 * 12/2016 Bruns ..... A45F 5/02
9,737,132 B2 * 8/2017 Bruns ..... A45F 5/021
9,923,590 B1 * 3/2018 Picking ..... A45F 3/14
9,983,624 B2 * 5/2018 Daley, III ..... G06F 1/1628
10,314,386 B1 * 6/2019 Baig ..... A45F 3/14
10,485,326 B2 * 11/2019 Williamson ..... A41D 1/04
10,660,426 B2 * 5/2020 Norman ..... A47B 23/002
10,761,568 B2 * 9/2020 Daley, III ..... H04N 5/64
10,772,411 B2 * 9/2020 Kippen ..... A45F 3/10
2002/0043545 A1 4/2002 Tang
2004/0011841 A1 * 1/2004 Sprague ..... A45C 13/30 224/638
2004/0187183 A1 9/2004 Hautala
2005/0072819 A1 4/2005 Maldonado et al.
2007/0164987 A1 7/2007 Graham
2008/0121730 A1 * 5/2008 Calkin ..... A45F 3/06 238/12
2010/0025444 A1 * 2/2010 Tipton ..... A45F 5/00 224/576
2010/0108726 A1 * 5/2010 Hilgenberg ..... A45F 3/04 224/153
2011/0303579 A1 * 12/2011 Sanders ..... A45F 5/00 206/701
2012/0037675 A1 2/2012 Shepherd et al.
2012/0175396 A1 * 7/2012 Patino ..... A45C 11/00 224/627
2012/0267409 A1 10/2012 Chavis
2012/0280009 A1 * 11/2012 Carroll ..... A45F 3/14 224/257
2013/0214022 A1 8/2013 Harvey
2014/0231482 A1 8/2014 Chamberlayne
2015/0076183 A1 * 3/2015 Palma ..... A45F 5/004 224/162
2015/0108186 A1 * 4/2015 Law ..... A45C 11/00 224/191
2015/0195392 A1 * 7/2015 Nissenbaum ..... A45F 5/00 455/569.1
2015/0205327 A1 * 7/2015 Daley, III ..... G06F 1/1698 361/679.03
2015/0208789 A1 * 7/2015 Pylkovas ..... A45C 3/02 224/607
2015/0354753 A1 * 12/2015 Courtwright ..... A44B 18/0069 248/444
2016/0147254 A1 * 5/2016 Daley, III ..... G06F 1/1616 348/725
2016/0198836 A1 * 7/2016 Fan ..... A45F 5/00 224/271
2016/0209869 A1 * 7/2016 Daley, III ..... A45F 5/00
2017/0055683 A1 3/2017 Willows et al.
2018/0098616 A1 * 4/2018 Iannotta ..... A45F 5/00
2019/0125062 A1 * 5/2019 Kippen ..... A45F 3/14
2019/0159579 A1 5/2019 Picking
2020/0229577 A1 * 7/2020 Jones ..... A45F 3/14
2021/0106125 A1 * 4/2021 Thomas ..... A45F 3/04

* cited by examiner

TETHERED CHEST POUCH ASSEMBLY

This application claims priority of U.S. Provisional Application No. 62/915,119, filed Oct. 15, 2019, and U.S. Provisional Application No. 63/011,626, filed Apr. 17, 2020, the entire contents of which are hereby incorporated by reference.

BACKGROUND OF THE INVENTION

The present invention relates to the field of bags and luggage. More particularly, the present invention relates to a body-worn carrier for personal electronic devices.

Mobile telephones and other personal electronic devices, such as tablet computers, digital cameras, and so forth, have proliferated. In the case of mobile telephones, their popularity is due, at least in part, to their versatile communication and computing capabilities, as well as their ability to perform multiple additional functions, such as GPS navigation and photography. Usefulness of such devices can be limited in some circumstances by their being prone to damage by being dropped or impacted by objects or by being exposed to dust, water, and other environmental hazards.

There is therefore a need for improved carriers for mobile telephones and other personal electronic devices.

SUMMARY OF THE INVENTION

The present invention provides a tethered chest pouch assembly for carrying a personal electronic device. In accordance with an embodiment, a pouch has a closable opening configured to receive a personal electronic device. A base panel is configured to be worn by a user in or around the user's chest area. One or more releasable fasteners are configured for releasably fastening the pouch to the base panel. One or more tethers are configured for attachment to the base panel and to the pouch. The pouch may be postionable with respect to the panel in at least: a closed position in which the pouch is releasably fastened by the releasable fasteners substantially flat against the panel; an open position in which a top of the pouch is rotated outwardly from the panel while the pouch remains attached to the panel near a lower edge of the pouch; and a tethered position in which the pouch is tethered to the panel.

In accordance with a further embodiment, a tethered chest pouch assembly for carrying a personal electronic device comprises a pouch having a closable opening configured to receive a personal electronic device. The assembly additionally comprises a base panel configured to be worn by a user in or around the user's chest area. The pouch is postionable with respect to the panel in at least: a closed position in which the pouch is releasably fastened substantially flat against the panel; an open position in which a top of the pouch is rotated outwardly from the panel while the pouch remains attached to the panel near a lower edge of the pouch; and a tethered position in which the pouch is tethered to the panel. One or more releasable fasteners may be provided for releasably fastening the pouch to the base panel. And, one or more tethers may be configured for tethered attachment of the pouch to the base panel.

These and other embodiments are described in more detail herein.

BRIEF DESCRIPTION OF THE DRAWINGS

The present invention is described with respect to particular exemplary embodiments thereof and reference is accordingly made to the drawings in which.

DETAILED DESCRIPTION OF A PREFERRED EMBODIMENT OF THE INVENTION

Figure 1A:
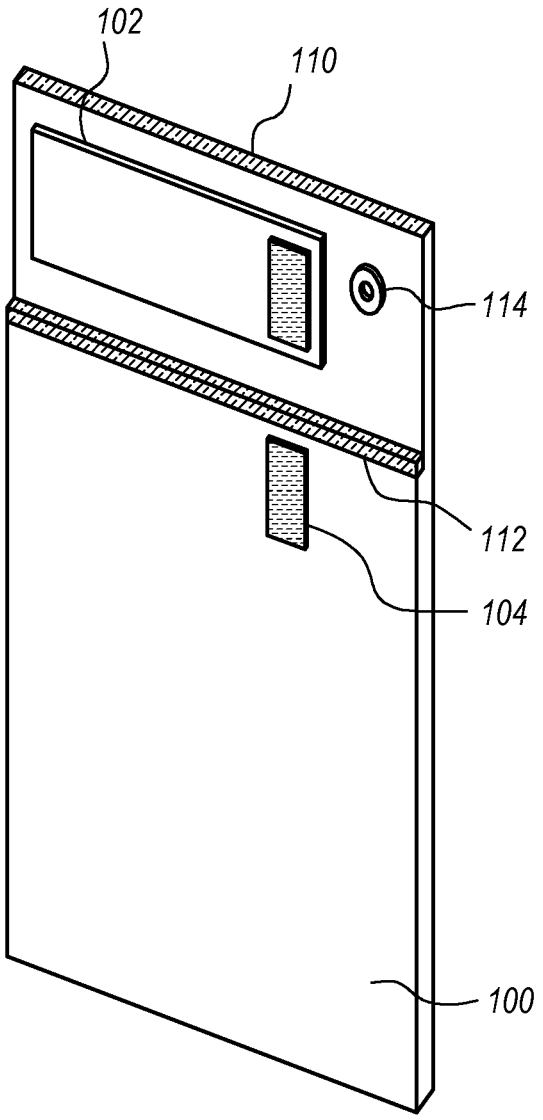
FIGS. 1A-B illustrate a front (outwardly facing) side of a pouch for an electronic device in accordance with an embodiment of the present invention.

The present invention comprises a pouch for carrying a personal electronic device, such as mobile telephone, tablet computer or camera. The pouch is coupled to a base panel that is configured to be worn at the front of the body of a user, for example, on the chest area of the user. The panel can be secured to the user, for example, by a harness or by the panel being incorporated into a garment worn by the user. The pouch can preferably be positioned with respect to the panel in at least three different positions: (1) a first ("closed") position in which the pouch is fastened substantially flat against the panel; (2) a second ("open") position in which the top of the pouch is rotated outwardly from the panel while the pouch remains attached to the panel near a lower edge of the pouch; and (3) a third ("tethered") position in which the pouch is tethered to the panel.

In the first position (i.e. the "closed" position), the pouch is secured against the panel such that the user can engage in activities without the electronic device interfering with the activities and without the user needing to hold, support or otherwise handle the electronic device. If the device is a camera or incorporates a camera, the camera can be activated to take one or more still photographs or to capture one or more video clips, e.g., in a "hands-free" manner while the person engages in activities.

In the second position (i.e. the "open" position), the pouch is rotated downward while still being attached near a lower edge of the pouch. In this position, the user can view and interact with a touch display screen and other interface components of the electronic device. For example, the user can read text or email messages on the display screen of the electronic device and type responses on a keypad or touch screen of the electronic device. Or, the person can place and receive telephone calls using a speakerphone functionality of the device or using earphones.

In the third ("tethered") position, the pouch is tethered to the panel by one or more tethers. The tethers can be, for example, flexible straps. In this configuration, the user can hold and move the electronic device with respect to the panel while the electronic device remains in the pouch. For example, the user can bring the electronic device to the user's face, for example, to use the viewfinder of a camera or to frame a photo on a display screen. As another example, if the electronic device is a mobile phone, the user can bring the device to the user's ear in order to engage in a telephone conversation without using the speakerphone functionality. Or, the user can hold the electronic device away from the user's body in order to more comfortably type or otherwise interact with the device. Importantly, in this third position, the pouch containing the electronic device remains tethered to the panel so that if the user drops the pouch containing the electronic device, the device will not drop to the ground but will instead remain suspended by the tether. This is especially useful in situations where a dropped device could become lost, broken or difficult to retrieve, such as when the user is riding in a boat, riding a ski chairlift, using a wheelchair, engaging in rock climbing, standing in a crowd of people, and so forth.

In a fourth configuration, the pouch can be completely decoupled from the panel, for example, by disconnecting the tethers from the pouch. The pouch can then be reattached to the tethers as desired.

In all four configurations, the electronic device can remain in, and therefore be protected by, the pouch. The pouch can include a front (outwardly facing) side that includes a camera lens opening. Thus, the electronic device can capture photographic images or video while still in the pouch. The pouch can include a back (inwardly facing) side that includes a transparent flexible film. Thus, the user can interact with a touch display screen of the electronic device through the transparent film. In addition to accommodating the electronic device, the pouch can be configured to hold small items such as car keys, lip balm, credit and ID cards and cash, and electronic device accessories, such as ear phones, charging cords and spare memory cards.

In an embodiment, the pouch has two chambers, one in front of the other. A first chamber closest to the user's body can be configured to accommodate an electronic device such as a smartphone or other electronic device and can be equipped with a transparent flexible film for allowing user to manipulate a touch screen of the device. A second chamber can be configured with a space configured to accommodate items such as a passport and cash bills. This second chamber is also equipped with slots for accommodating a plurality, e.g., four, standard plastic cards (e.g., credit or ID cards). In an embodiment, the panel can be equipped with one or more slots or chambers for carrying items.

The pouch is preferably constructed of a flexible and sturdy fabric, such as nylon fabric, spandex or canvas. In an embodiment, a padded layer, e.g., a closed cell foam or foamed neoprene, is also provided adjacent to the fabric. The panel can be constructed of the same or similar materials, and also preferably includes a rigid or semi-rigid panel which aids the panel maintaining a substantially flat shape. The panel can be, for example, slightly taller than a common smartphone and slightly wider than a passport. The panel can be equipped with four (a pair in each horizontal direction) of straps with clasps on each side configured to removably attach to harness webbing. Alternatively, or additionally, the panel can be equipped with one or more loops, e.g., at the top and bottom, to attach to sternum straps on backpacks that are not adjustable, or backpacks that only have one sternum strap, by passing the sternum straps of the backpack through the one or more loops.

Figure 1B:
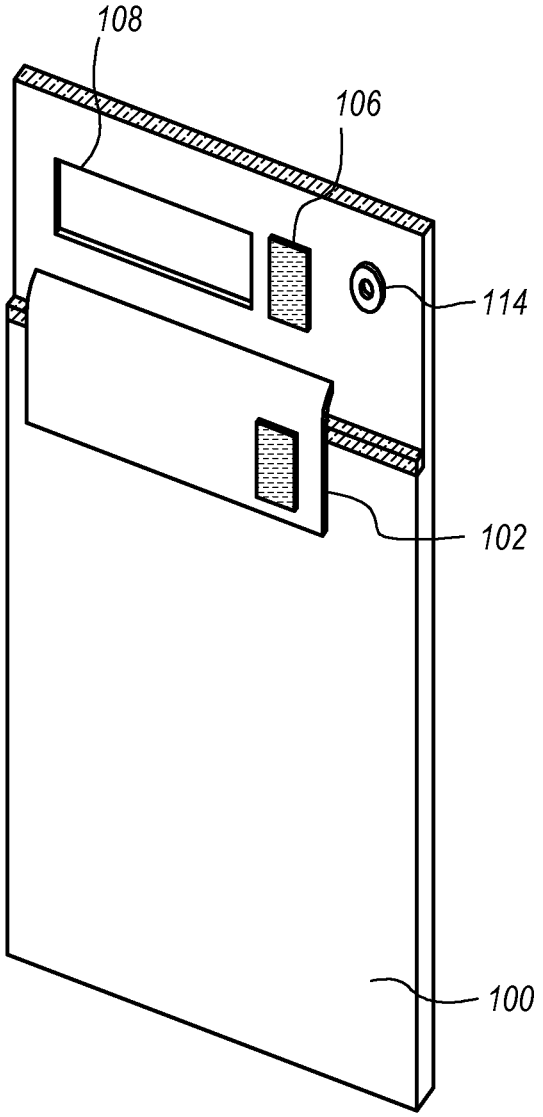

FIGS. 1A-B illustrate a front (outwardly facing) side of a pouch 100 for an electronic device in accordance with an embodiment of the present invention. A flap 102 can be positioned raised or lowered. FIG. 1A shows the flap in the raised (or closed) position, while FIG. 1B shows the flap in the lowered position. In either the raised or the lowered position, the flap can be held in that position by a hook and loop fastener. More particularly, a first portion of a hook and loop fastener 104 can be attached to a first side of the flap 102 while a second portion of the hook and loop fastener 104 can be attached to the front of the pouch 100. Similarly, a first portion of hook and loop fastener 106 can be attached to a first side of the flap 102 while a second portion of the hook and loop fastener 106 can be attached to the front of the pouch 100. The in the lowered position, the flap 102 exposes an opening 108 which can be aligned with a camera lens of the electronic device. In the raised position, the flap 102 covers the opening 108 thereby protecting the camera lens of the electronic device. It will be apparent that the opening 108 can be covered with a transparent film or lens, in which case, the flap 102 can be omitted.

A horizontal fastener 110 such as zipper can be provided along a top edge of the pouch 100 through which an electronic device can be inserted in a first chamber of the pouch 100. A second horizontal fastener 112, such as a zipper, can be provided along a top edge of a second chamber through which other items, such as a passport and plastic cards, can be inserted into the second chamber. One or more detachable fasteners are also provided near one or more top corners of the pouch 100. As shown in FIGS. 1A-B, a base 114 of a snap button can be positioned in one upper corner of the pouch 100. It will be apparent that zippers and snap buttons, as illustrated in FIGS. 1A-B, as well as other fasteners illustrated and described throughout this document and drawings, are exemplary of various types of releasable fasteners that can be employed in connection with the present invention. Other possible releasable fasteners include, but are not limited to: plastic snap zippers such as are used in ZIPLOC brand and other plastic re-sealable bags; two-part snap buttons, button and eye fasteners, magnets or hook and loop fasteners.

Therefore, as shown in FIGS. 1A-B, there are two chambers, each assessable by a horizontal fastener 110 and 112, respectively. The front chamber can be configured with the dimensions that accommodate a passport, while the rear chamber can be configured with the dimensions that accommodate a smartphone.

Figure 2:
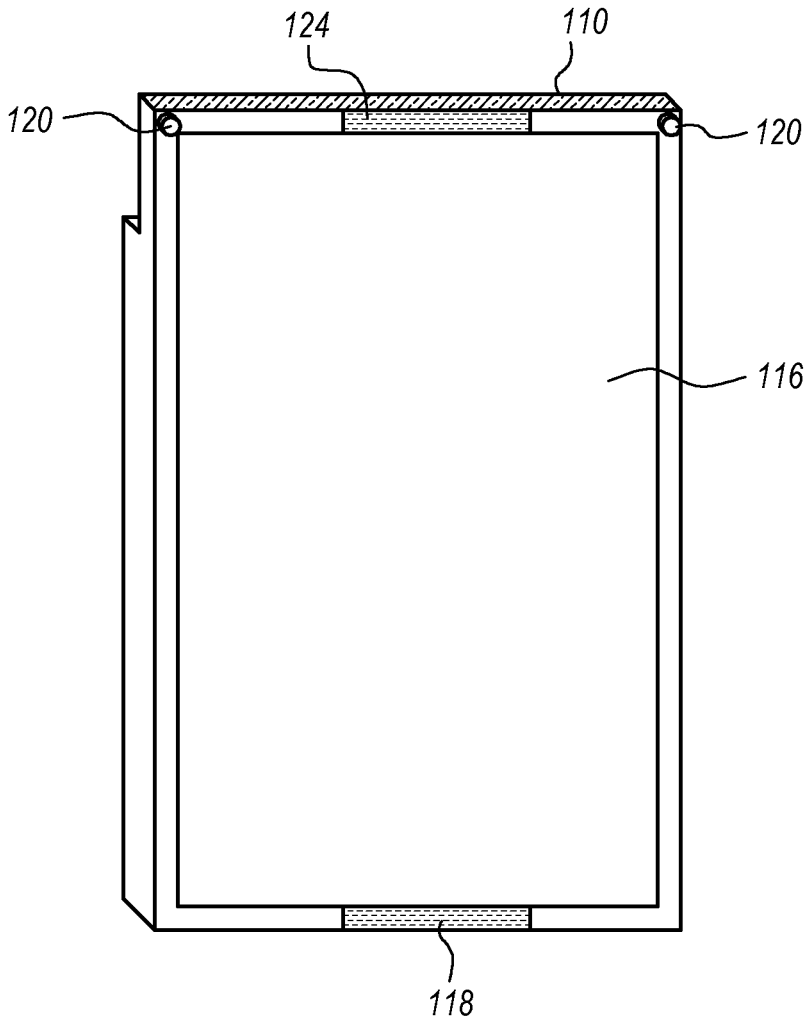
FIG. 2 illustrates a back (inwardly facing) side of the pouch in accordance with an embodiment of the present invention.
Figure 3:
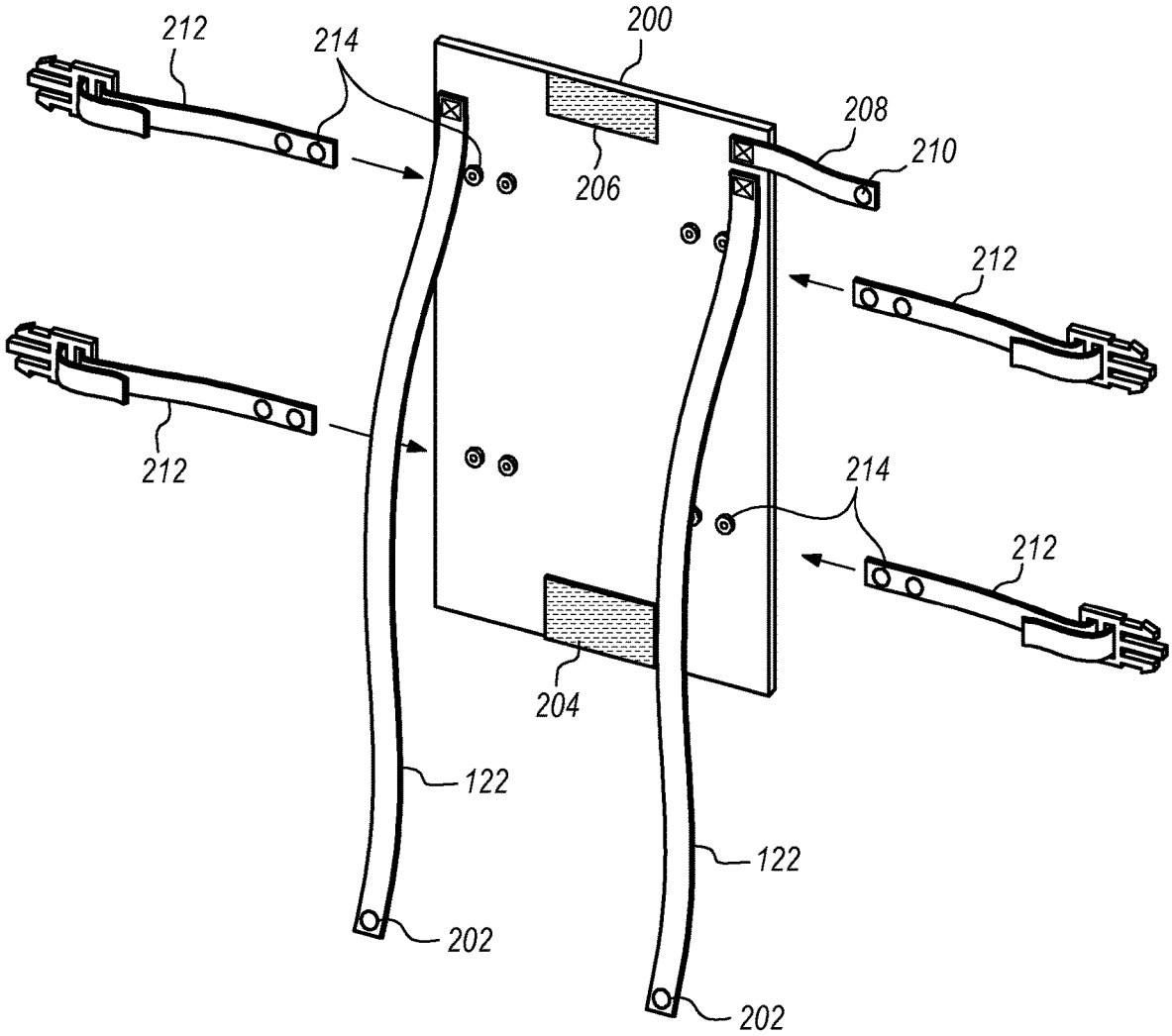
FIG. 3 illustrates a front (outwardly facing) side of a chest-worn panel in accordance with an embodiment of the present invention.
Figure 6:
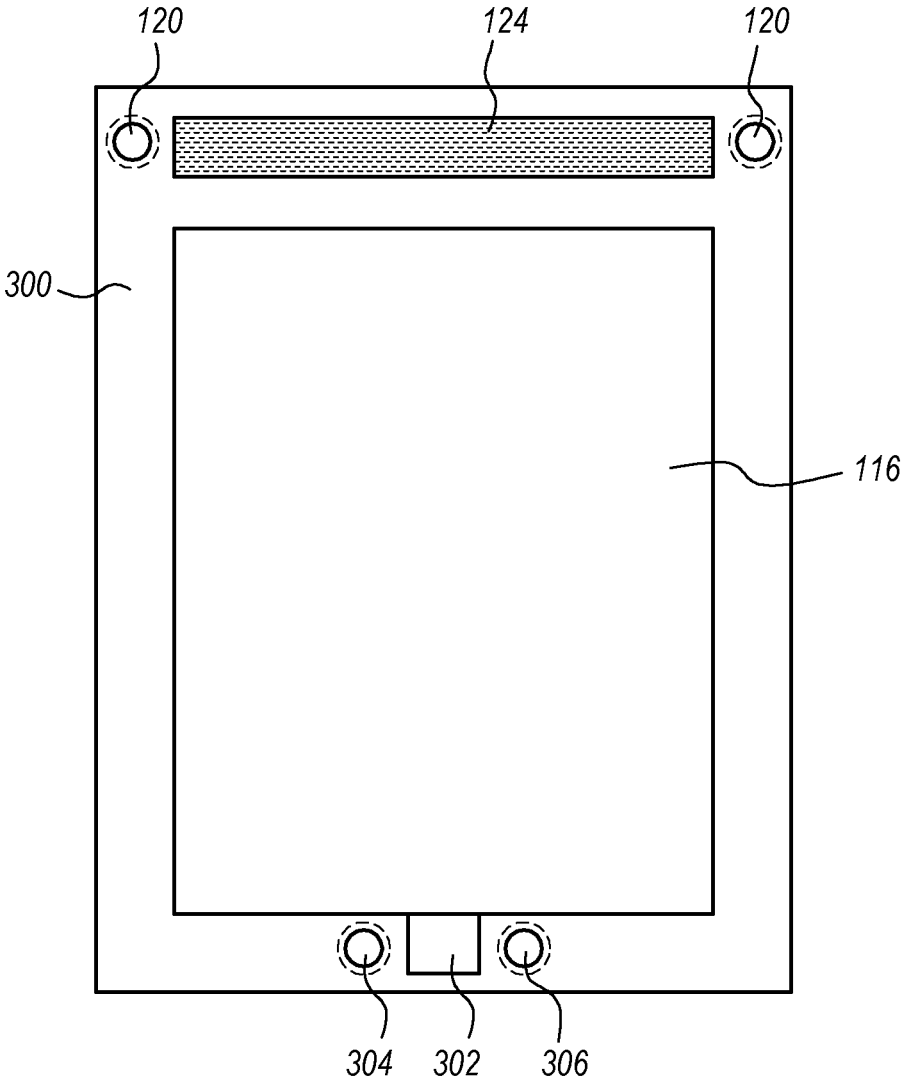
FIG. 6 illustrates an alternative embodiment of a back (inwardly facing) side of pouch for an electronic device in accordance with an embodiment of the present invention.

FIG. 2 illustrates a back (inwardly facing) side of the pouch 100 in accordance with an embodiment of the present invention. FIG. 2 illustrates the user-facing side of the pouch, which is the reverse of the side shown in FIGS. 1A-B. As shown in FIG. 2, a tactile, transparent plastic film 116 is provided to allow a user to interface with a touch screen of the electronic device. A hook and loop fastener 118 is attached near the middle of a bottom edge of the pouch 100. The hook and loop fastener 118 can alternatively extend substantially the entire width of the pouch 100. Also, buttons, for example, could be used as a substitute for the hook and loop fastener 118. Snap button fasteners 120 are provided near each of two upper corners of the pouch 100. These fasteners 120 attach to buttons of the ends of long tethers 122 (FIG. 3). A fastener 124, e.g., a hook and loop fastener material, is attached near a top center of the pouch 100 and is provided to attach and detach to a top portion of the 200 (FIG. 3). FIG. 6 additionally shows the horizontal fastener 124.

FIG. 3 illustrates a front (outwardly facing) side of a chest-worn panel 200 in accordance with an embodiment of the present invention. The panel 200 serves as a base for the pouch 100. The panel 200 can be, for example, made of neoprene, leather, cloth, or some other material. One or more tethers 122 are, at or near one end, preferably permanently affixed to the panel 200. These tethers 122 are preferably longer than a longest dimension of the panel 200, itself. A releasable fastener 202, such as a button or hook and loop fastener, is attached to each tether 122 at or near an end of each tether 122 opposite to the end that is permanently affixed to the panel 200. These fasteners 202 are attachable to the fasteners 120 located near top corners of the user-facing side of the pouch 100 (FIG. 2).

A fastener 204, e.g., a hook and loop fastener, is attached near a lower edge of the panel 200. The fastener 204 can be removably attached to pouch 100 by fastener 118 (FIG. 2). The fasteners 118 and 204 function as a hinge that allows the pouch 100 to pivot downward while still being attached to the panel 200. A fastener 206, such as a hook and loop fastener, is affixed to the panel 200 near the top of the panel. This fastener 206 can be removably attached to fastener 124 (FIG. 2). The fasteners 118 and 204 function to hold the pouch 100 against the panel 200. However, the user can release the fasteners 118 and 204 so that the pouch 100 can pivot downward while still attached by fasteners 118 and 204.

One or more tethers 208 are, at or near one end, preferably permanently affixed to the panel 200. The tether 208 (also referred to as "short" tether) can be substantially shorter than the tethers 122 (also referred to as "long" tethers). A releasable fastener 210, such as a button or hook and loop fastener, is attached to the tether 208 at or near an end of the tether 208 opposite to the end that is permanently affixed to the panel 200. This fastener 210 is attachable to the fastener base 114 located near top corner (s0 of the outward-facing side of the pouch 100 (FIGS. 1A-B). The tether 208 can be used to maintain the pouch 100 in its pivoted position when the fasteners 118 and 204 are released. In this position, the user can access a display screen on the electronic device through the transparent film 116 (FIG. 2).

Thus, the panel 200 can be tethered to the pouch 100 using two different lengths of tethers having different purposes. First, affixed near the top of the panel is an (approximately) three to four inch long tether 208 that removably attaches to an upper portion of the pouch 100, preferably on the front facing side of the pouch 100. Second, affixed to the panel 200 are one or more (approximately) eight to ten inch long tethers 122 that are removably attached to the pouch 100. The short tether 208 is configured to allow the user to release the top of the pouch 100 from the panel 200 so that the top of the pouch 100 moves away from the panel 200 by a few inches while the bottom of the pouch 100 remains attached to the panel. This allows the user to view and interact with a user interface of the electronic device. When the short tether 208 is released and the lower portion of the pouch 100 is released from the panel 200, the pouch 100 can remain tethered to the panel 200 by the long tethers 122. In this configuration, the user has additional freedom to move the pouch 100 with respect to the panel 200. For example, the user can lift the pouch 100 away from the panel, for example, to reach the user's face to talk on the phone or to frame photographs.

While the tethers 122 and 208 are preferably permanently affixed to the panel 200 at one end and removably attached to the pouch 100 at their opposite ends, it will be apparent that either or both types of tethers 122 and 208 can be permanently affixed to the pouch 100 at one end and removably attached to the panel 200 at their opposite ends. It will also be apparent that either or both types of tethers 122 and 20 can be removably attached at both ends to the pouch 100 and the panel 200.

FIG. 3 also shows a number of straps 212 which can be used to secure the panel 200 to a harness 1000 (FIG. 10) which can be worn by the user. Each strap 212 can be secured to the panel by one or more sets of releasable fasteners 214, such as snap buttons.

Figure 4:
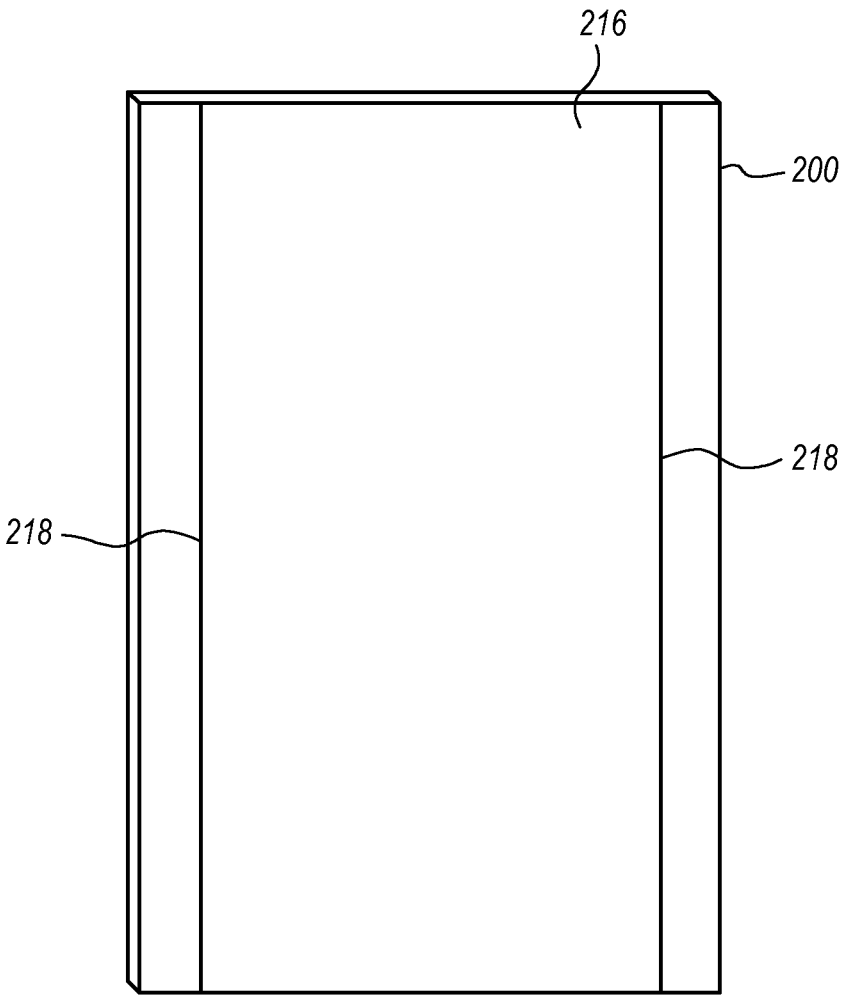
FIG. 4 illustrates a back (inwardly facing) side of the chest-worn panel in accordance with an embodiment of the present invention.
Figure 5A:
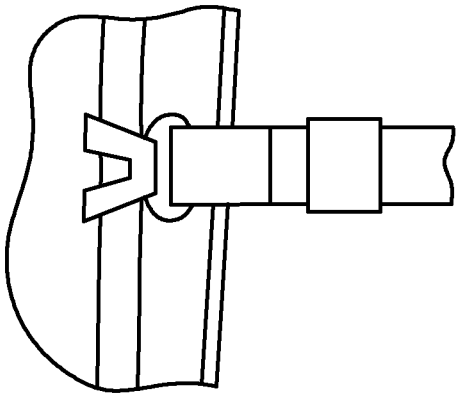
FIGS. 5A-E illustrate examples of strap clasps in accordance with embodiments of the present invention.
Figure 5D:
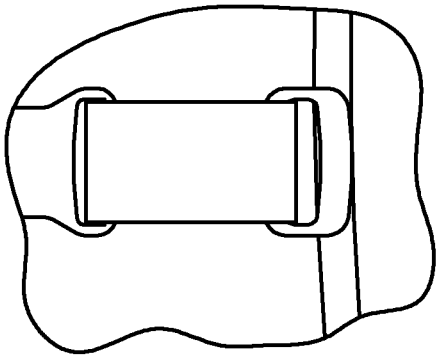
Figure 5B:
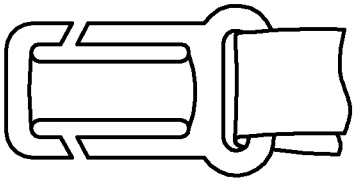
Figure 5E:
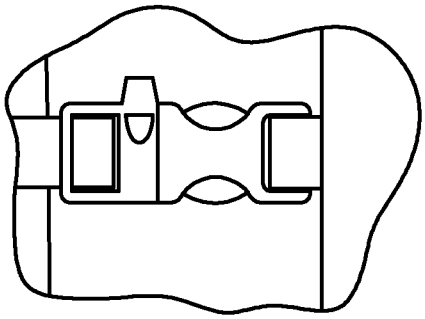
Figure 5C:
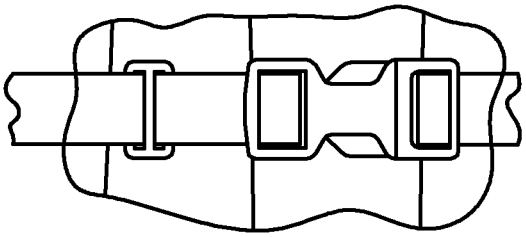

FIG. 4 illustrates a back (inwardly facing) side of the chest-worn panel 200 in accordance with an embodiment of the present invention. This side of the panel 200 can be placed in contact with the user's chest when in use. A loop 216 of material with open sides can be provided on this side of the panel 200 so that the panel 200 can hang onto sternum straps that already exist in certain backpacks. Such sternum straps can extend horizontally through openings 218 on the sides of the loop 216. The loop 216 and its openings 218 are therefore sufficiently large as to accommodate the sternum straps of a commercially-available backpack.

FIGS. 5A-E illustrate examples of strap clasps in accordance with embodiments of the present invention. These strap clasps can be used, for example, on straps 212 (FIG. 3). Most attach to vertical webbing. Some clasp onto edges in the front straps of a backpack to slide vertically. The utility is essentially equivalent such that any of these fasteners can be used in connection with the present invention.

FIG. 6 illustrates an alternative embodiment of a back (inwardly facing) side of pouch 300 for an electronic device in accordance with an embodiment of the present invention. FIG. 6 shows rear side of the pouch 100. The pouch 100 of FIG. 6 differs from that of FIG. 2 in that the transparent film 116 includes a projecting part 302 at the bottom of the film 116. This part 302 can be used where the electronic device has a user input, e.g., a "home" button near the bottom of its display screen. The pouch 300 of FIG. 6 also differs from that of FIG. 2 in that the lower central part of the back of the pouch 300 is configured with, e.g. two, removable fasteners which can be in the form of snap button fasteners 304 and 306. These fasteners 304, 306 can engage with corresponding fasteners on the panel 200. The fasteners 304 and 306 can be expected to attach to the panel 200 with greater tension than is the case of hook and loop fasteners, allowing the top to easily detach from the panel 200 (FIG. 2) but preventing the bottom from inadvertently being detached.

Figure 7:
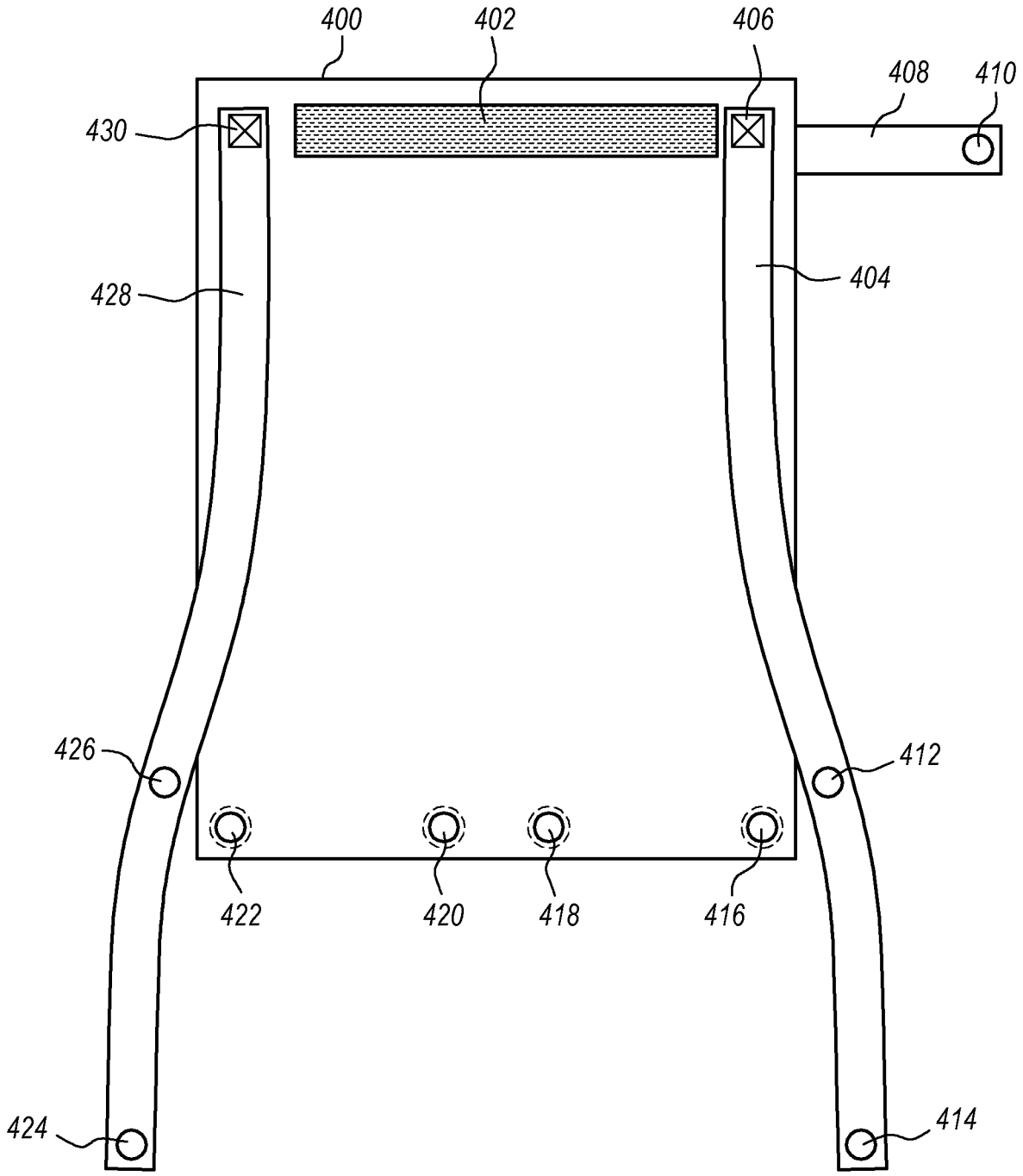
FIG. 7 illustrates an alternative embodiment of a front (outwardly facing) side of a chest-worn panel in accordance with an embodiment of the present invention.

FIG. 7 illustrates an alternative embodiment of a front (outwardly facing) side of a chest-worn panel 400 in accordance with an embodiment of the present invention. A removable fastener 402 in the form of hook and loop fastener is located at an upper middle portion of the panel 400. A long tether 404 is permanently attached near an upper right corner of the panel 400 with box stitching 406 in this embodiment. The tether 404 has a removable fastener 412 in the form of a button that can attach to a reciprocal fastener 416. The tether 404 also has a removable fastener 414 in the form of a button at the bottom. A long tether 428 is also permanently attached near an upper left corner of the panel 400 with box stitching 430 in this embodiment. The tether 428 has a removable fastener 426 in the form of a button that can attach to a reciprocal fastener 422. The tether 428 also has a removable fastener 424 in the form of a button at the bottom. In the bottom center of the front of the panel are two removable fasteners 418,4 in the form of buttons. Near the upper right corner of the panel 400, a short tether 408 is preferably permanently attached. Near an oppose end of the tether 408 is a removable fastener 410 in the form of a button.

Each tether 404, 428 has a light-tension fastener 412, 426 that is configured to attach to a respective fastener 416, 422 bottom corner of the panel 400 for the purposes of preventing the tether from hanging out in unsightly way. At the end of each tether 404, 428 is a strong-tension fastener 414, 424, configured to attach to a respective upper corner of the pouch 100. In the lower central parts of the front of the panel 400 are two light-tension fasteners 418, 420. These fasteners 418, 420, are used in conjunction with the short tether 410 to allow the pouch 100 to pivot forward with respect to the panel 400.

In an embodiment, tension of the fasteners takes into consideration the expected weight of the pouch 100 containing a typical electronic device. For example, a typical smartphone may weight approximately 8 ounces while the pouch 100 itself may weigh approximately 3 ounces. Therefore, the fasteners used for securing the long tethers 122, 428 should be able to withstand the force of dropping an 11 ounce weight from a height of equal to the length of the tethers 122, 428 (e.g., 8 inches) without releasing. However, the fasteners should not take significantly more force to disengage as this would result in the having difficulty releasing them when desired.

Figure 8:
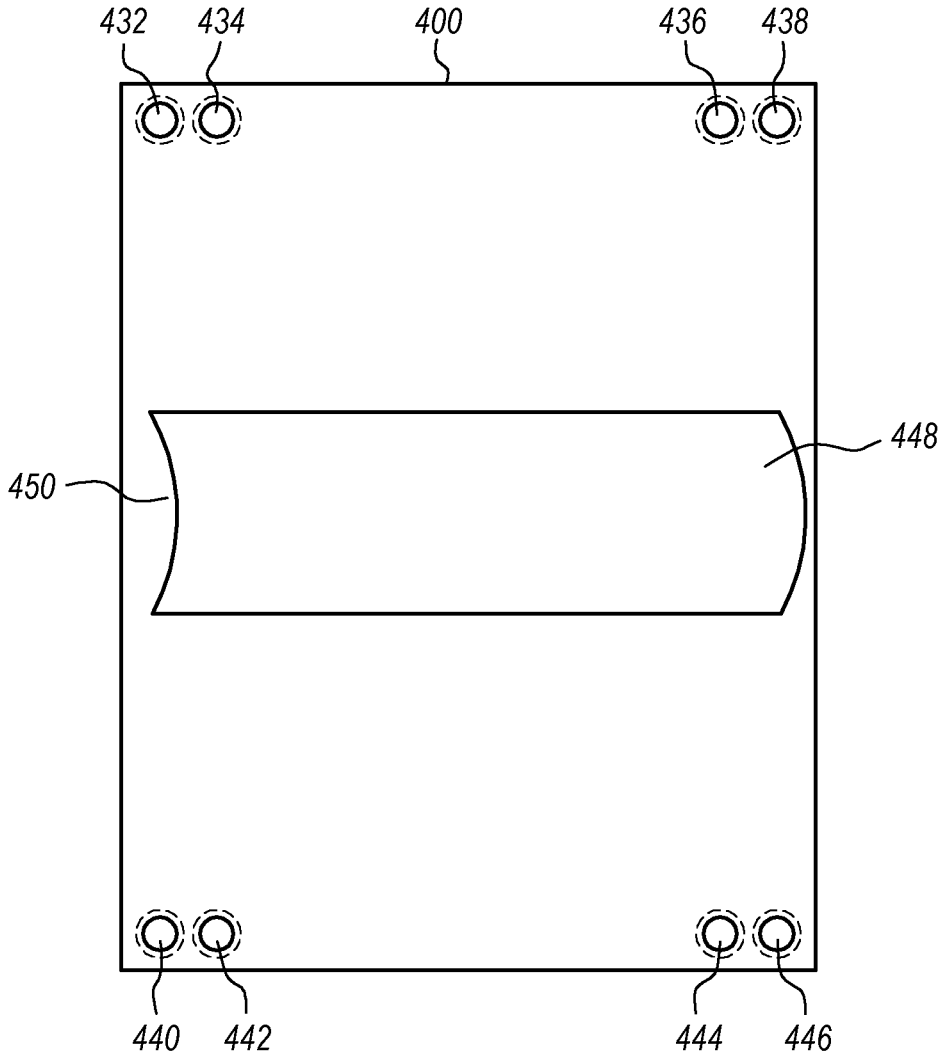
FIG. 8 illustrates an alternative embodiment of a back (inwardly facing) side of the chest-worn panel in accordance with an embodiment of the present invention.

FIG. 8 illustrates an alternative embodiment of a back (inwardly facing) side of the chest-worn panel 400 in accordance with an embodiment of the present invention.

Pairs of removable fasteners 432 and 434, 436 and 438, 440 and 442, 444 and 4460 in the form of snap buttons a positioned in each of the four corners of the panel 400. These fasteners are configured to removably attach to and detach from a sternum strap of a harness. A loop or tube 448 having a passage 450 with two open ends for a sternum strap that may exist on a backpack is positioned across the middle of the panel 400.

Figure 9:
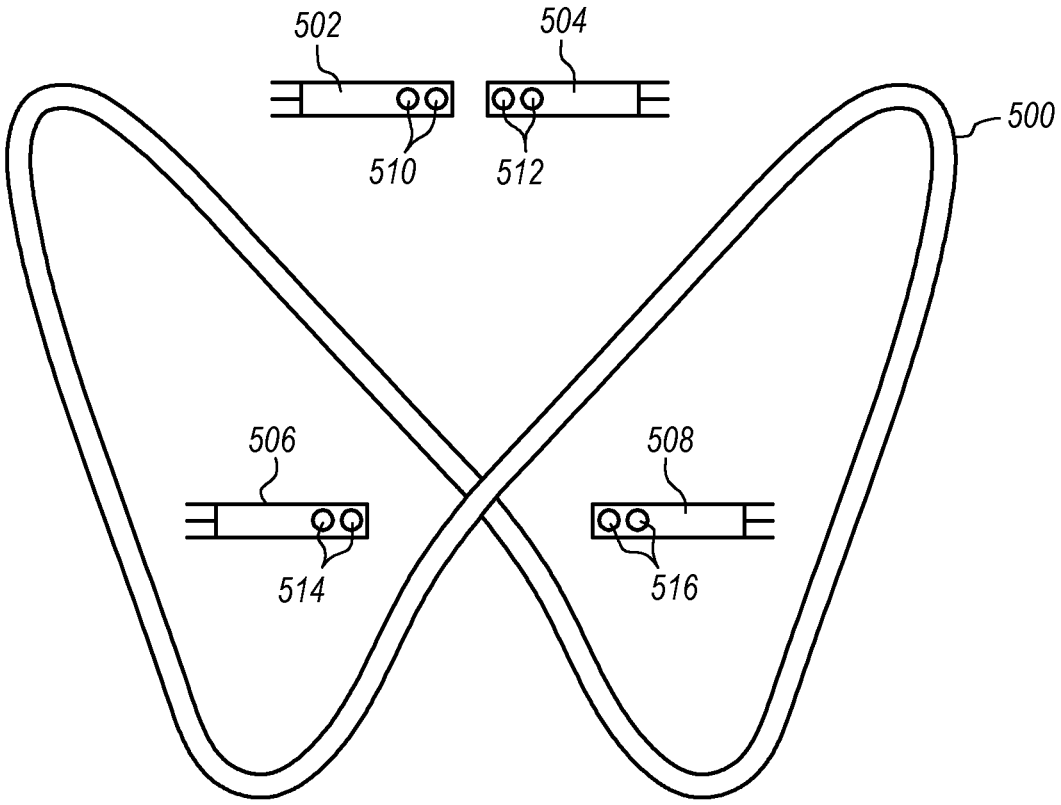
FIG. 9 illustrates a harness in accordance with an embodiment of the present invention.

FIG. 9 illustrates a harness 500 in accordance with an embodiment of the present invention. The harness 500 is configured to position the panel 200 (FIGS. 3-4) or panel 4000 (FIGS. 7-8) in the chest area of a user. In an embodiment, the harness 500 comprises webbing or straps that are configured to pass over a user's shoulders, cross each other at the user's back and pass beneath the user's arms on each side. The webbing or straps are additionally configured to connect to each other at the front of the user. The webbing at the user's chest is compatible with clasps on removable sternum straps 502, 504, 506, 508 that can be attached to the panel 200, 4000 with removable fasteners 510, 512, 514, 516 which can be snap buttons.

Figure 10:
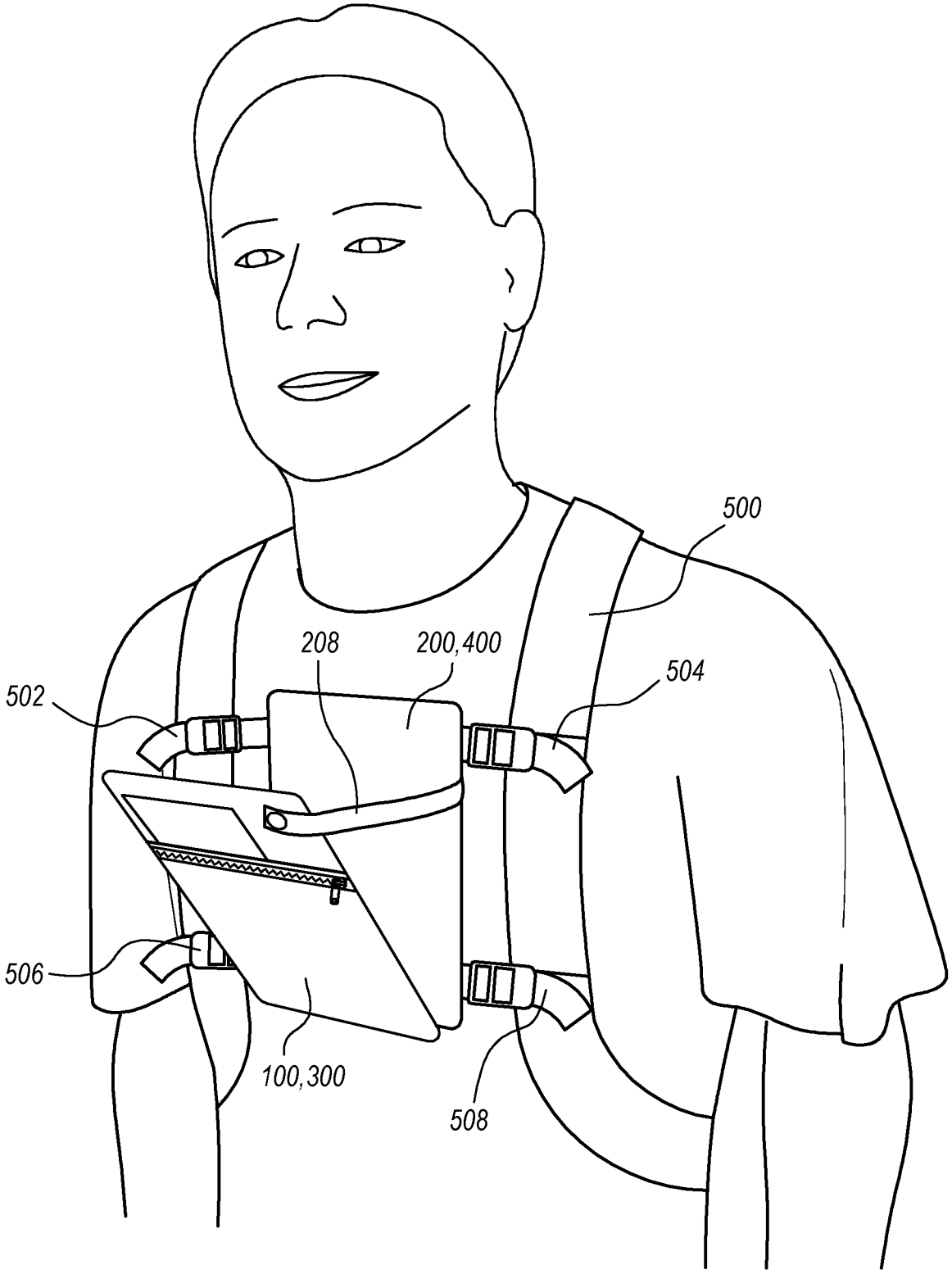
FIG. 10 illustrates a pouch and panel in an open position in accordance with an embodiment of the present invention.

FIG. 10 illustrates a pouch 100, 300 and panel 200, 400 in an open position in accordance with an embodiment of the present invention. The pouch 100, 300 can also be attached to the panel 200, 400 by a short tether 208 with a removable fastener 210 (FIG. 3). FIG. 10 also shows details of the harness 500 and straps 502, 504, 506, 508. In this position, the user can view and interact with a touch display screen of the electronic device without having to hold or otherwise support the electronic device. For example, the user can read a phone hands free. Also, the user may type into the phone.

Figure 11:
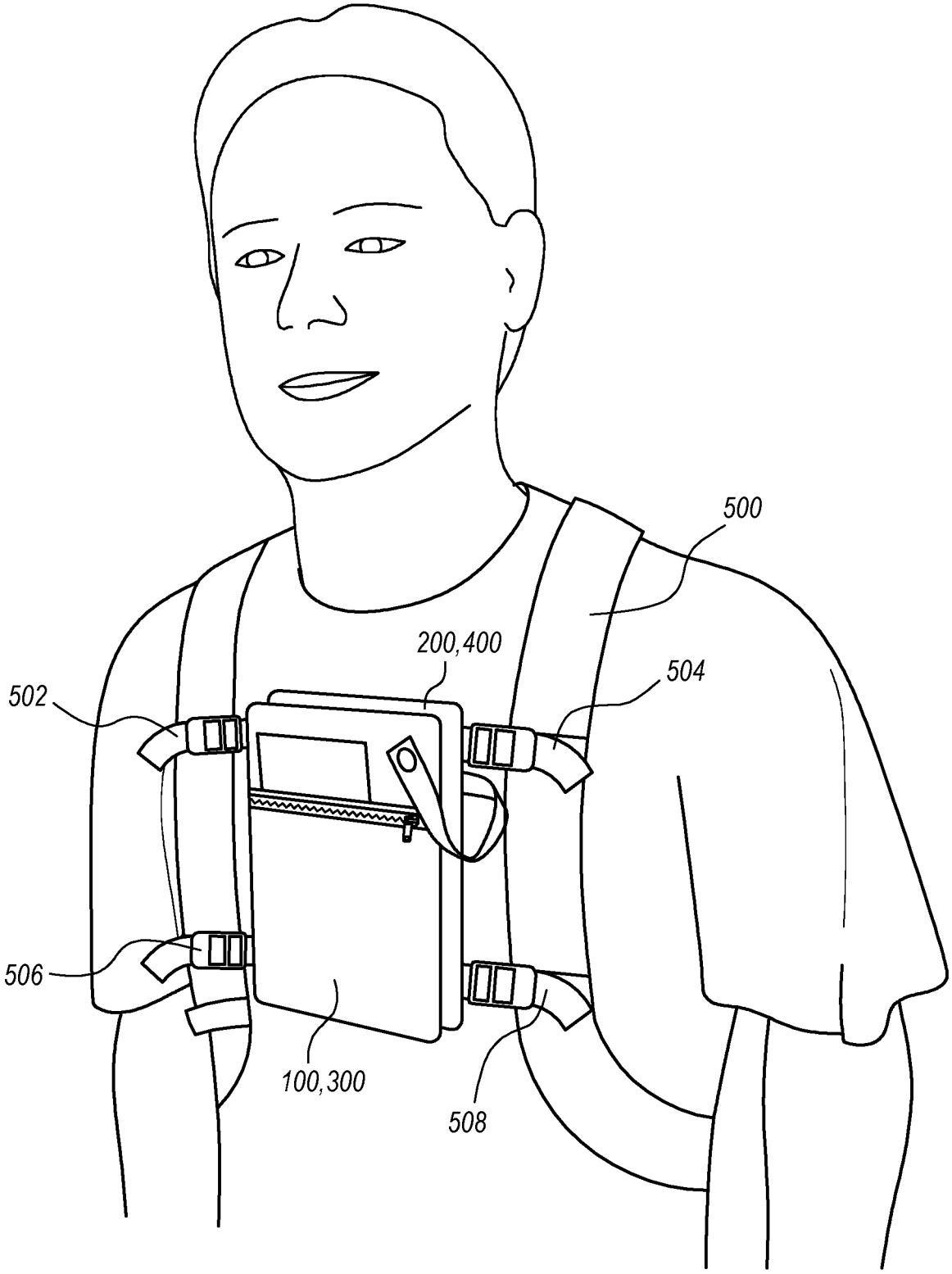
FIG. 11 illustrates a pouch and panel in a closed position in accordance with an embodiment of the present invention.

FIG. 11 illustrates a pouch 100, 300 and panel 200, 400 in a closed position in accordance with an embodiment of the present invention. FIG. 11 also shows details of the harness 500 and straps 502, 504, 506, 508. In this position, the electronic device is secured so that the user can engage in activities without having to hold or otherwise support the electronic device and without fear of dropping the electronic device. The electronic device can be activated to capture video, images or sound in this position. More particularly, the user can move the flap to its up or down positions to reveal or hide a camera lens of the electronic device.

If the user desires to view the display screen of the electronic device, the user can easily release the fasteners at the top of the pouch 100 which allows the pouch 100 to pivot downwardly to the open position as shown in FIG. 10. Additionally, once the device is in the open position, as in FIG. 10, the user can easily move the pouch 100 back to the closed position where the fasteners near the top of the pouch 100 will secure the pouch 100 in the closed position, as in FIG. 11.

Figure 12:
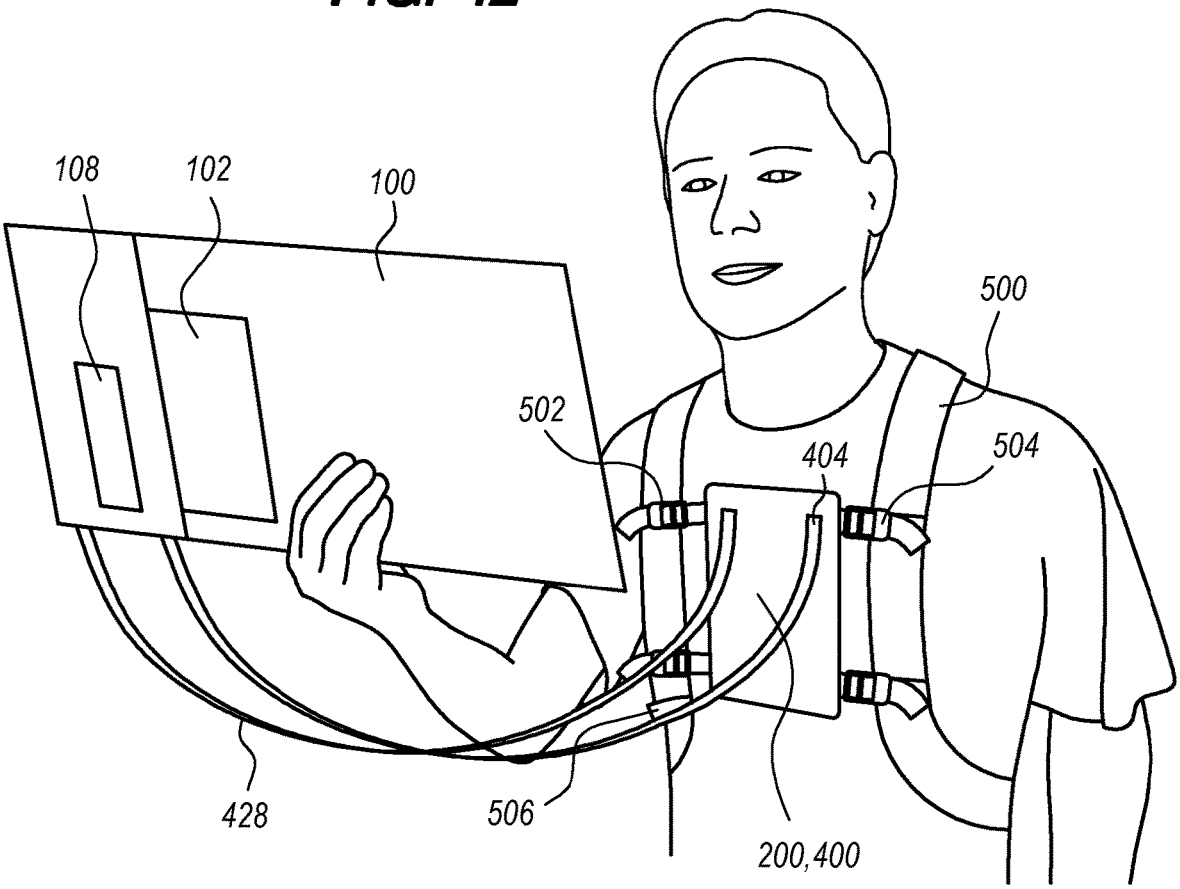
FIG. 12 illustrates a pouch in a tethered position with respect to a panel in accordance with an embodiment of the present invention.

FIG. 12 illustrates a pouch 100, 300 in a tethered position with respect to a panel 200, 400 in accordance with an embodiment of the present invention. As shown on FIG. 12, the user holds the pouch 100 containing the electronic device. However, the pouch 100 remains attached to the panel 6, 800, by tethers 804, 828. This prevents the pouch 100 containing the electronic device from falling the ground in case the user happens to let go of the pouch 1. To move the pouch 100 from the open position, as in FIG. 10, to the tethered position, as in FIG. 12, the user releases the fastener 210 (FIG. 3) of the short tether 20 (FIGS. 3 and 10) and releases the fasteners near the bottom of the pouch 100. To move the pouch 100 from the tethered position, as in FIG. 12, to the open position, as in FIG. 10, the user reattaches the fasteners near the bottom of the pouch 100 and reattached the fastener 210 (FIG. 3) of the short tether 20 (FIGS. 3 and 20). FIG. 12 also shows details of the harness 1000 and straps 1002, 1004, 1006, 1008.

Figure 13:
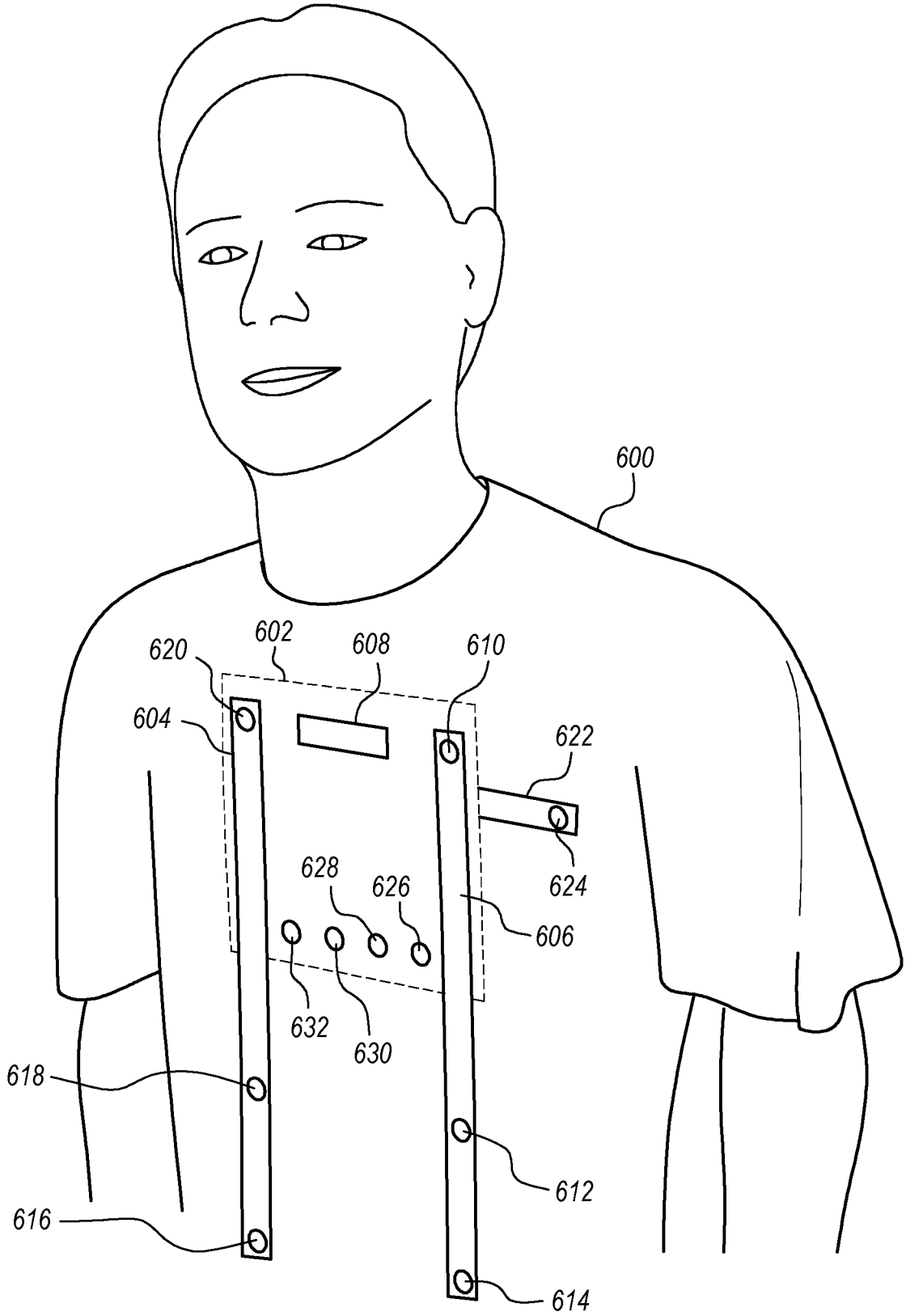
FIG. 13 illustrates a garment with a panel incorporated into the garment in accordance with an embodiment of the present invention.

FIG. 13 illustrates a garment 600 with elements of a base panel 1401 incorporated into the garment in accordance with an embodiment of the present invention. A removable fastener 1406 in the form of hook and loop fastener is positioned at an upper middle portion of the panel 1401. This fastener 1406 can engage with a corresponding fastener 124 (FIG. 6) of the pouch 100. A long tether 1404 is permanently attached in an upper right corner of the panel 1401 in an embodiment by box stitching 1408. The tether 1404 has a removable fastener 1410 in the form of a snap button that can attach to a reciprocal fastener 1424 of the panel 1401. The tether 1404 also has a removable fastener 1412 in the form of a snap button near an opposite end of the tether 1402. A long tether 1402 is permanently attached in an upper left corner of the panel 1401 in an embodiment by box stitching 1418. The tether 1404 has a removable fastener 1416 in the form of a snap button 1416 that can attach to a reciprocal fastener 1430 of the panel 1401. The tether 1402 also has a removable fastener 1414 in the form of a button at near an opposite end of the tether 1402. Two removable fasteners 1426, 1428, in the form of buttons, are positioned near a lower center of the front of the panel 1401. These fasteners 1426, 1428, can engage with corresponding fasteners 304, 306 (FIG. 6) of the pouch 100. A short tether 1420 is attached near an upper right corner of the panel 1401. This tether 1402 has a removable fastener 1422 in the form of a snap button near an opposite end of the tether 1402. This fastener 1422 can engage with a corresponding fastener base 114 (FIGS. 1A-B) of the pouch 100. The embodiment of the panel 1401 of FIG. 13 preferably has all of the features and functionality of the panel 800 of FIG. 7 incorporated directly into garment, i.e. an article of clothing, which in this case is a t-shirt.

The foregoing detailed description of the present invention is provided for the purposes of illustration and is not intended to be exhaustive or to limit the invention to the embodiments disclosed. Accordingly, the scope of the present invention is defined by the appended claims.

What is claimed is:

1. A tethered chest pouch assembly for carrying a personal electronic device comprising:

a pouch having a closable opening configured to receive a personal electronic device;

a base panel configured to be worn by a user in or around the user's chest area;

one or more releasable fasteners for releasably fastening the pouch to the base panel; and at least two tethers configured for attachment to the base panel and to the pouch, the at least two tethers comprising:

a first tether attached near a top portion of the panel and to an upper portion of the pouch so that the pouch is positionable in an open position in which a top of the pouch is rotated outwardly from the panel while the pouch remains attached to the panel near a lower edge of the pouch; and a second tether whose length is at least approximately twice that of the first tether, wherein when the first tether is released and the second tether is attached, the second tether permits the pouch to be moved away from the panel.

2. The tethered chest pouch assembly according to claim 1 further comprising a closed position in which the pouch is releasably fastened by the releasable fasteners substantially flat against the panel.

3. The tethered chest pouch assembly according to claim 2, wherein at least the second tether is releasable such that the pouch can be releasably decoupled from the panel.

4. The tethered chest pouch assembly according to claim 3, wherein a release force for decoupling the pouch from the panel is greater than a force generated by dropping the pouch.

5. The tethered chest pouch assembly according to claim 1, wherein the pouch comprises a transparent film that is configured so that the user can interact with a display screen of a personal electronic device located in the pouch.

6. The tethered chest pouch assembly according to claim 1, wherein the pouch comprises closable window that is configured to selectively expose a camera lens of a personal electronic device located in the pouch.

7. The tethered chest pouch assembly according to claim 1, wherein when the pouch is in the open position, the user can view and access a touch screen of a personal electronic device located in the pouch.

8. The tethered chest pouch assembly according to claim 1, wherein the panel is configured to be worn by the user using one or more of the following means: a harness; sternum straps of a backpack; the panel being incorporated into a wearable garment.

9. The tethered chest pouch assembly according to claim 1, wherein the pouch comprises a first compartment configured to hold a personal electronic device and a second compartment configured to hold user identification documents, cash or payment cards.

10. A tethered chest pouch assembly for carrying a personal electronic device comprising:

a pouch having a closable opening configured to receive a personal electronic device;

a base panel configured to be worn by a user in or around the user's chest area, wherein the pouch is postionable with respect to the panel in at least:

a closed position in which the pouch is releasably fastened substantially flat against the panel;

an open position in which a top of the pouch is rotated outwardly from the panel while a first tether is attached near a top portion of the panel and to an upper portion of the pouch and the pouch remains attached to the panel near a lower edge of the pouch; and a tethered position in which the first tether is released and the pouch is tethered to the panel by a second tether whose length is at least approximately twice that of the first tether and in which the pouch is movable away from the panel.

11. The tethered chest pouch assembly according to claim 10, wherein at least the second tether is releasable such that the pouch can be releasably decoupled from the panel.

12. The tethered chest pouch assembly according to claim 11, wherein a release force for decoupling the pouch from the panel is greater than a force generated by dropping the pouch.

13. The tethered chest pouch assembly according to claim 10, wherein the pouch comprises a transparent film that is configured so that the user can interact with a display screen of a personal electronic device located in the pouch.

14. The tethered chest pouch assembly according to claim 10, wherein the pouch comprises closable window that is configured to selectively expose a camera lens of a personal electronic device located in the pouch.

15. The tethered chest pouch assembly according to claim 10, wherein when the pouch is in the open position, the user can view and access a touch screen of a personal electronic device located in the pouch.

16. The tethered chest pouch assembly according to claim 10, wherein the panel is configured to be worn by the user using one or more of the following means: a harness; sternum straps of a backpack; the panel being incorporated into a wearable garment.

17. The tethered chest pouch assembly according to claim 10, wherein the pouch comprises a first compartment configured to hold a personal electronic device and a second compartment configured to hold user identification documents, cash or payment cards.

* * * * *